US009299516B2

(12) United States Patent
Chen et al.

(10) Patent No.: US 9,299,516 B2
(45) Date of Patent: Mar. 29, 2016

(54) LUMINOUS KEYBOARD DEVICE

(71) Applicant: Primax Electronics Ltd., Neihu, Taipei (TW)

(72) Inventors: Chung-Yuan Chen, Taipei (TW); Hsuan-Wei Ho, Taipei (TW)

(73) Assignee: Primax Electronics Ltd., Taipei (TW)

( * ) Notice: Subject to any disclaimer, the term of this patent is extended or adjusted under 35 U.S.C. 154(b) by 335 days.

(21) Appl. No.: 14/019,105

(22) Filed: Sep. 5, 2013

(65) Prior Publication Data

US 2014/0367238 A1 Dec. 18, 2014

(30) Foreign Application Priority Data

Jun. 17, 2013 (TW) ..... 102121389

(51) Int. Cl.
*H01H 13/83* (2006.01)
*H01H 3/12* (2006.01)

(52) U.S. Cl.
CPC ..... *H01H 13/83* (2013.01); *H01H 3/125* (2013.01); *H01H 2219/036* (2013.01); *H01H 2219/044* (2013.01); *H01H 2219/06* (2013.01); *H01H 2219/062* (2013.01); *H01H 2219/064* (2013.01)

(58) Field of Classification Search
CPC . H01H 13/83; H01H 3/125; H01H 2219/064; H01H 2219/044; H01H 2219/06; H01H 2219/062; H01H 2219/036; H01H 13/023; H01H 2013/026; H01H 9/161; H01H 9/182
USPC ..... 362/23.01
See application file for complete search history.

(56) References Cited

U.S. PATENT DOCUMENTS 8,334,794 B2 * 12/2012 Watanabe ..... G06F 3/0202 341/20
2009/0251920 A1 * 10/2009 Kino ..... B60Q 1/323 362/602
2011/0168538 A1 * 7/2011 Hwa ..... H01H 13/83 200/5 A
2012/0013272 A1 * 1/2012 Huang ..... G06F 3/0202 315/312

* cited by examiner

*Primary Examiner* — Diane Lee
*Assistant Examiner* — Naomi M Wolford
(74) *Attorney, Agent, or Firm* — Kirton McConkie; Evan R. Witt

(57) ABSTRACT

A luminous keyboard device includes a keypad module, a supporting plate, a light-mixing type light-emitting element, a first light guide plate, and a second light guide plate. The supporting plate has a partition part. By the partition part, a first color light beam and a second color light beam from the light-mixing type light-emitting element are not mixed with each other. The first color light beam is guided by the first light guide plate to a first light-outputting zone and a third light-outputting zone of the keypad module. The second color light beam is guided by the second light guide plate to a second light-outputting zone and the third light-outputting zone of the keypad module. The first color light beam and the second color light beam projected on the third light-outputting zone are mixed as a third color light beam.

20 Claims, 6 Drawing Sheets

LUMINOUS KEYBOARD DEVICE

FIELD OF THE INVENTION

The present invention relates to a keyboard device, and more particularly to a luminous keyboard device.

BACKGROUND OF THE INVENTION

Generally, the widely-used peripheral input device of a computer system includes for example a mouse device, a keyboard device, a trackball device, or the like. Via the keyboard device, characters and symbols can be inputted into the computer system directly. As a consequence, most users and most manufacturers of the input devices pay much attention to the development of keyboard devices. That is, the manufacturers of the input devices make efforts in designing novel keyboard devices with diversified functions. For operating the keyboard device in a dark environment, one of the conventional approaches is to install an electroluminance plate within the keyboard device and use the electroluminance plate as a light source. When the electroluminance plate is powered by electricity, the electroluminance plate is enabled to emit a light beam, and thus the keyboard device exhibits luminous efficacy. However, since the electroluminescence plate is only able to emit a monochromatic light beam, the conventional luminous keyboard device can only exhibit a single light color. In another conventional approach of operating the keyboard device in a dark environment, light emitting diodes (LED) are installed under respective keys to be used as dot light sources. However, the approach of installing the light emitting diodes under respective keys may increase the fabricating cost of the luminous keyboard device and reduce the heat-dissipating efficiency of the luminous keyboard device.

For solving the above two drawbacks, a luminous keyboard device is disclosed in for example Taiwanese Patent Publication No. TW200945113. FIG. 1 is a schematic top view illustrating the outer appearance of a conventional luminous keyboard device. As shown in FIG. 1, the conventional luminous keyboard device 10 comprises plural keys such as numeric keys, symbol keys, alphabetic keys, arrow keys, space key, and function keys. Moreover, each of the alphabetic keys "W", "A", "S", "D", the space key, the "Enter" key and the up/down/left/right arrow keys is illuminated in a color different from other keys. For example, the conventional luminous keyboard device 10 is a keyboard device for a notebook computer.

FIG. 2 is a schematic cross-sectional view illustrating the conventional luminous keyboard device of FIG. 1 and taken along the line A-A'. As shown in FIG. 2, the conventional luminous keyboard device 10 comprises a keypad module 100 and an illumination module 200. The illumination module 200 is located under the keypad module 100. The keypad module 100 comprises plural keys 112, 114, plural elastic elements 120, plural scissors-type connecting element 130 and a membrane switch circuit member 140. When one of the keys 112 and 114 is depressed by a user, a corresponding key signal is generated. In response to the key signal, a command is provided to a computer (not shown) that is in communication with the conventional luminous keyboard device 10, thereby controlling execution of a corresponding program. The illumination module 200 comprises a light-shading member 210, a light guide plate 220, a reflector 230, a first light-emitting element 240, and a second light-emitting element 250. The light guide plate 220 comprises a first light-guiding region 222, a second light-guiding region 224 and a light-shading region 226. The light-shading region 226 is arranged between the first light-guiding region 222 and the second light-guiding region 224. For example, the light-shading region 226 is a gap. Through the light-shading region 226, the light guide plate 220 is divided into the first light-guiding region 222 and the second light-guiding region 224. For enhancing the light-shading efficacy, the light-shading region 226 further contains a light-shading material (or a reflective material) 227. The light-shading material (or a reflective material) 227 is formed on at least one interface between the light-shading region 226 and the first light-guiding region 222 or the second light-guiding region 224.

In the illumination module 200, the first light-emitting element 240 is used for emitting a first color light beam (e.g. a white light beam) to the first light-guiding region 222. The second light-emitting element 250 is used for emitting a second color light beam (e.g. a blue light beam) to the second light-guiding region 224. The first light-guiding region 222 and the second light-guiding region 224 are separated from each other by the light-shading region 226, so that the first color light beam and the second color light beam are not mixed with each other.

The light-shading member 210 has a predetermined pattern. The first color light beam from the first light-emitting element 240 and the second color light beam from the second light-guiding region 224 are transmissible through the predetermined pattern, so that the possibility of scattering the light beams will be reduced. Moreover, the light-shading member 210 may be a light-shading pigment layer or a thin resin film with a light-shading pigment coating. For example, the thin resin film is a polyethylene terephthalate (PET) thin film or a polyvinylchloride (PVC) thin film. The light-shading member 210 has plural openings 215 corresponding to the positions of the keys to be illuminated. Consequently, the light beams can be guided by the light guide plate 220 to be directed to the corresponding keys (e.g. the keys 112 and 114). Moreover, for preventing the light beams from being scattered through the region between every two adjacent keys, the openings 215 of the light-shading member 210 are slightly smaller than the corresponding keys (see FIG. 2).

The light guide plate 220 is located under the light-shading member 210 for guiding the first color light beam and the second color light beam, so that the light guide plate 220 is served as a light transfer medium. The first light-guiding region 222, the second light-guiding region 224 and the light-shading region 226 of the light guide plate 220 are integrally formed with each other. Moreover, the second light-guiding region 224 is surrounded by the light-shading region 226 (i.e. the gap), so that the first light-guiding region 222, the second light-guiding region 224 and the light-shading region 226 are respectively defined (see FIG. 3).

FIG. 3 is a schematic top view illustrating the illumination module of the conventional luminous keyboard device of FIG. 2. As shown in FIGS. 2 and 3, plural first light-emitting elements 240 are located beside at least one lateral edge of the first light guide region 222. The first color light beam from the first light-emitting element 240 is guided by the first light-guiding region 222 and transmitted through the openings 215 of the light-shading member 210. Consequently, at least a specified key (e.g. the key 112) of the keypad module 100 is illuminated by the first color light beam. On the other hand, at least one second light-emitting element 250 is disposed within each second light-guiding region 224. The second color light beam from the second light-emitting element 250 is guided by the second light-guiding region 224 and transmitted through the openings 215 that are located over the second light-guiding region 224. Consequently, at least a specified key (e.g. the key 114) of the keypad module 100 corresponding to second light-guiding region 224 is illuminated by the second color light beam. It is noted that the positions, sizes, number and distribution of the second light-guiding region 224 may be determined according to the specific keys to be illuminated by the second color light beam. For example, the second light-guiding region 224 under the alphabetic keys "W", "A", "S" and "D" has inverted T-shaped profiles. In addition, the second light-guiding region 224 under the space key has a rectangular profile. The reflector 230 is located under the light guide plate 220. The first color light beam or the second color light beam scattered by the light guide plate 220 can be reflected by the reflector 230 in order to be reused. As a consequence, the light utilization efficiency is enhanced, and the scattered light is reduced.

The first light-emitting element 240 and the second light-emitting element 250 are light emitting diodes for emitting different color light beams, so that the predetermined positions of the keypad module 100 are illuminated in different colors. For example, the first light-emitting element 240 is a white light LED and the second light-emitting element 250 is a blue light LED. Consequently, the keypad module 100 will exhibit a white-color area (e.g. the position of key 112) and a blue-color area (e.g. the position of the key 114).

From the above discussions, the structures and operating principles of the conventional luminous keyboard device 10 for exhibiting various light colors have been described. The keys of the luminous keyboard device 10 may exhibit various colors for facilitating the user to recognize and operate the keys of the luminous keyboard device 10 in a dark environment. However, the processes of additionally installing the second light-emitting element 250, the second light-guiding region 224 and the light-shading region 226 in the light guide plate 220 are very complicated, very difficult and time-consuming. In other words, the fabricating cost of the luminous keyboard device 10 is increased.

Therefore, there is a need of providing a luminous keyboard device that is fabricated in a simplified process.

SUMMARY OF THE INVENTION

It is an object of the present invention to provide a luminous keyboard device that is fabricated in a simplified process.

It is another object of the present invention to provide a luminous keyboard device with reduced fabricating cost.

In accordance with an aspect of the present invention, there is provided a luminous keyboard device. The luminous keyboard device includes a keypad module, a supporting plate, an illumination circuit board, a first light-emitting element, a second light-emitting element, a first light guide plate, and a second light guide plate. The keypad module is exposed to a top surface of the luminous keyboard device. The supporting plate is located under the keypad module and connected with the keypad module for supporting the keypad module. The supporting plate includes a first supporting plate opening and a second supporting plate opening. The illumination circuit board is located near the supporting plate for providing electric power. The first light-emitting element is disposed on a top surface of the illumination circuit board. In response to the electric power, the first light-emitting element emits a first color light beam. The second light-emitting element is disposed on a bottom surface of the illumination circuit board. In response to the electric power, the second light-emitting element emits a second color light beam. The first light guide plate is arranged between the keypad module and the supporting plate for guiding the first color light beam to be directed to a first light-outputting zone of the keypad module. The second light guide plate is located under the supporting plate for guiding the second color light beam to be directed to a second light-outputting zone of the keypad module through the first supporting plate opening. When the first color light beam is guided by the first light guide plate to be projected on a third light-outputting zone of the keypad module and when the second color light beam is guided by the second light guide plate to be projected on the third light-outputting zone through the second supporting plate opening, the first color light beam and the second color light beam projected on the third light-outputting zone are mixed as a third color light beam.

In accordance with another aspect of the present invention, there is provided a luminous keyboard device. The luminous keyboard device includes a keypad module, a supporting plate, an illumination circuit board, a light-mixing type light-emitting element, a first light guide plate, and a second light guide plate. The keypad module is exposed to a top surface of the luminous keyboard device. The supporting plate is located under the keypad module and connected with the keypad module for supporting the keypad module. The supporting plate includes a first supporting plate opening and a second supporting plate opening. The illumination circuit board is located near the supporting plate for providing electric power. The light-mixing type light-emitting element is disposed on a top surface of the illumination circuit board and located near the supporting plate. The light-mixing type light-emitting element includes a first light-emitting part and a second light-emitting part. The first light-emitting element emits a first color light beam in response to the electric power. The second light-emitting element emits a second color light beam in response to the electric power. The first light guide plate is arranged between the keypad module and the supporting plate for guiding the first color light beam to be directed to a first light-outputting zone of the keypad module. The second light guide plate is located under the supporting plate for guiding the second color light beam to be directed to a second light-outputting zone of the keypad module through the first supporting plate opening. When the first color light beam is guided by the first light guide plate to be projected on a third light-outputting zone of the keypad module and when the second color light beam is guided by the second light guide plate to be projected on the third light-outputting zone through the second supporting plate opening, the first color light beam and the second color light beam projected on the third light-outputting zone are mixed as a third color light beam.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For eliminating the drawbacks encountered from the prior art, the present invention provides a luminous keyboard device.

Figure 1:
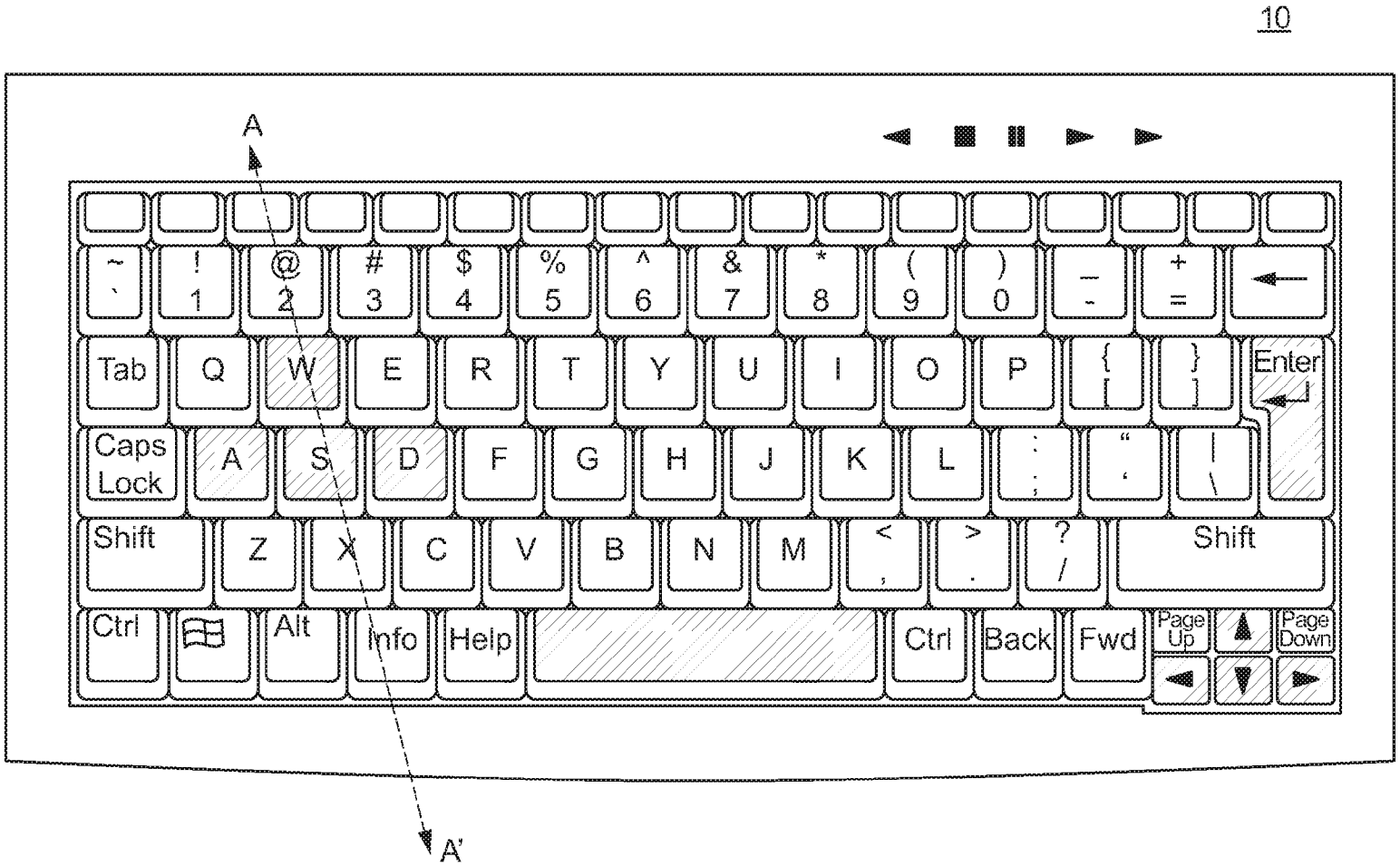
FIG.1 PRIOR ART
FIG. 1 is a schematic top view illustrating the outer appearance of a conventional luminous keyboard device.
Figure 2:
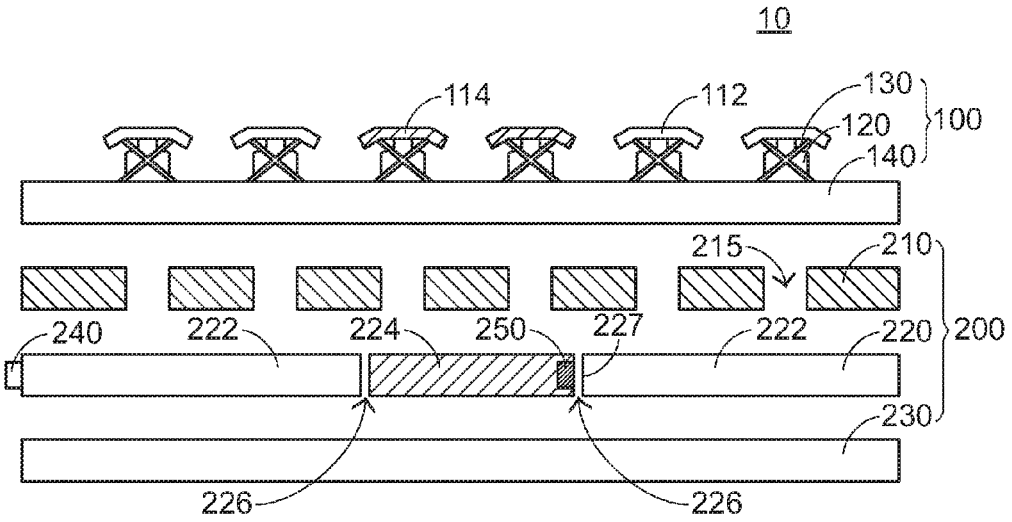
FIG.2 PRIOR ART
FIG. 2 is a schematic cross-sectional view illustrating the conventional luminous keyboard device of FIG. 1 and taken along the line A-A'.
Figure 3:
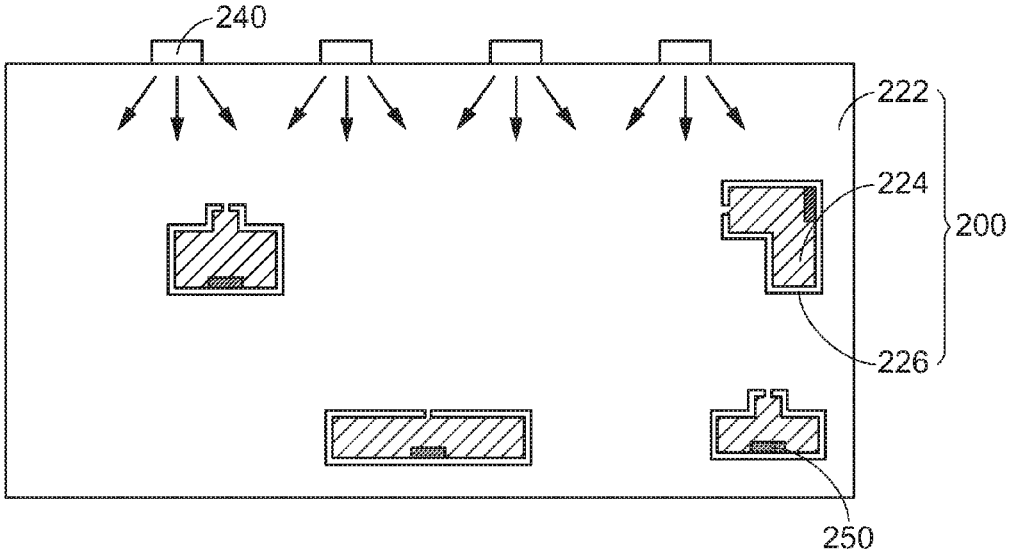
FIG.3 PRIOR ART
FIG. 3 is a schematic top view illustrating the illumination module of the conventional luminous keyboard device of FIG. 2.
Figure 4:
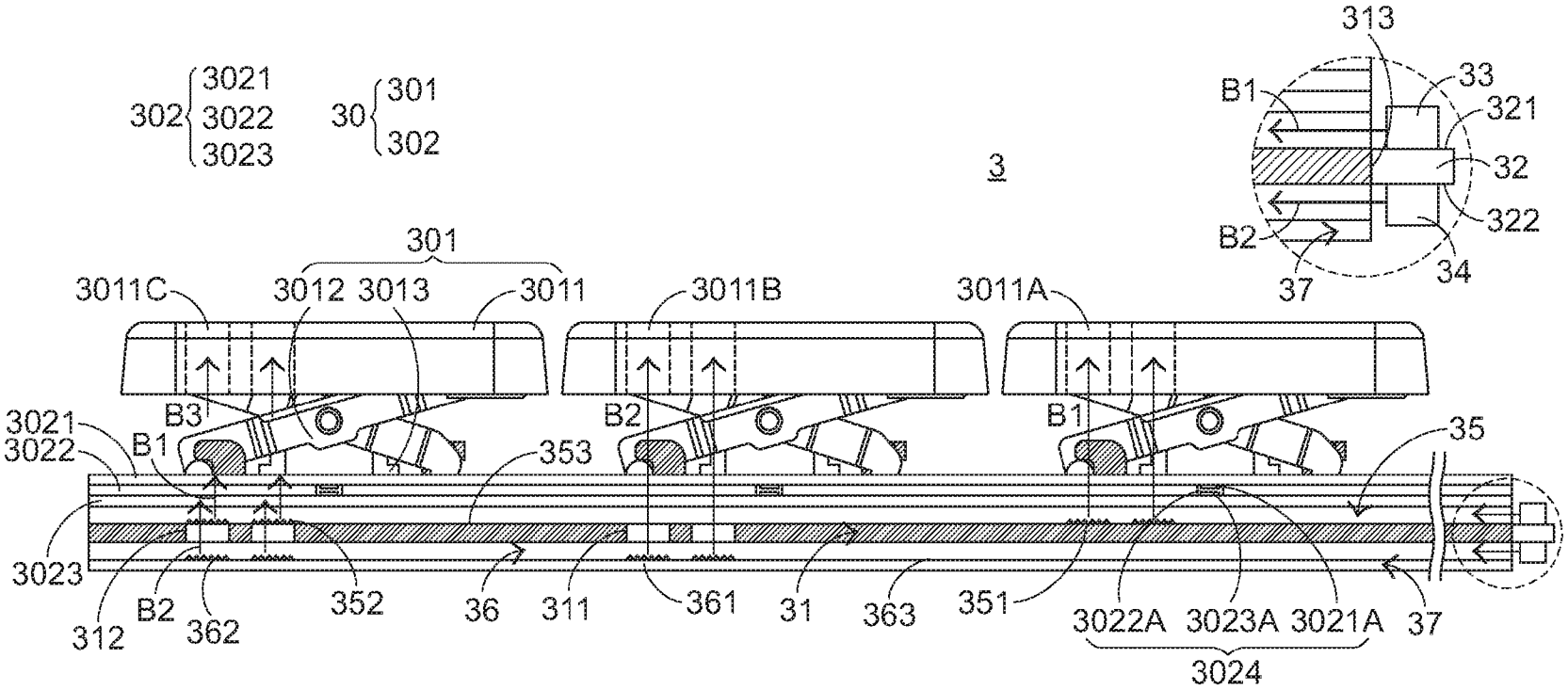
FIG. 4 is a schematic cross-sectional view illustrating a luminous keyboard device according to a first embodiment of the present invention.

FIG. 4 is a schematic cross-sectional view illustrating a luminous keyboard device according to a first embodiment of the present invention. As shown in FIG. 4, the luminous keyboard device 3 comprises a keypad module 30, a supporting plate 31, an illumination circuit board 32, a first light-emitting element 33, a second light-emitting element 34, a first light guide plate 35, a second light guide plate 36, and a reflecting part 37. The keypad module 30 is exposed to a top surface of the luminous keyboard device 3. Moreover, the keypad module 30 comprises plural keys 301 and a membrane switch circuit member 302. Each of the keys 301 comprises a keycap 3011, a connecting element 3012, and an elastic element 3013. The keycap 3011 is exposed outside the top surface of the luminous keyboard device 3. As shown in FIG. 4, the right keycap 3011 has plural first light-outputting zones 3011A, the middle keycap 3011 has plural second light-outputting zones 3011B, and the left keycap 3011 has plural third light-outputting zones 3011C. The connecting element 3012 is arranged between the supporting plate 31 and the keycap 3011. The connecting element 3012 is used for connecting the supporting plate 31 and the keycap 3011 and allowing the keycap 3011 to be moved upwardly or downwardly relative to the supporting plate 31. The elastic element 3013 is arranged between the membrane switch circuit member 302 and the keycap 3011 for providing an elastic force to the keycap 3011. In response to the elastic force, the keycap 3011 can be returned to its original position. The detailed inner structures of the membrane switch circuit member 302 will be illustrated later.

In this embodiment, the luminous keyboard device 3 is a keyboard device for a notebook computer (not shown). Moreover, the connecting element 3012 is a scissors-type connecting element, and the elastic element 3013 is a light-transmissible rubbery elastomer. It is noted that the connecting element 3012 is not restricted to the scissors-type connecting element. For example, in some other embodiments, the connecting element is implemented by another connecting structure.

The supporting plate 31 is located under the keypad module 30 and connected with the plural connecting elements 3012 of the keypad module 30 for supporting the keypad module 30. The supporting plate 31 comprises plural first supporting plate openings 311 and plural second supporting plate openings 312. Each of the first supporting plate openings 311 is aligned with a corresponding second light-outputting zone 3011B and located under the corresponding second light-outputting zone 3011B. Each of the second supporting plate openings 312 is aligned with a corresponding third light-outputting zone 3011C and located under the corresponding third light-outputting zone 3011C. Moreover, the supporting plate 31 is made of an opaque material.

The illumination circuit board 32 is located near the supporting plate 31 and located at a lateral edge 313 of the supporting plate 31 for providing electric power to the first light-emitting element 33 and the second light-emitting element 34. The first light-emitting element 33 is disposed on a top surface 321 of the illumination circuit board 32. By acquiring the electric power, the first light-emitting element 33 emits a first color light beam B1. The second light-emitting element 34 is disposed on a bottom surface 322 of the illumination circuit board 32. By acquiring the electric power, the second light-emitting element 34 emits a second color light beam B2. In this embodiment, the illumination circuit board 32 is a flexible circuit board. Moreover, both of the first light-emitting element 33 and the second light-emitting element 34 are side-view light-emitting diodes. The first color light beam B1 is a red light beam, and the second color light beam B2 is a blue light beam.

Please refer to FIG. 4 again. The first light guide plate 35 is arranged between the membrane switch circuit member 302 of the keypad module 30 and the supporting plate 31 for guiding the first color light beam B1 to be directed to the first light-outputting zones 3011A of the keycap 3011, so that the first color light beam B1 is outputted from the first light-outputting zones 3011A. The second light guide plate 36 is located under the supporting plate 31 for guiding the second color light beam B2 to be transmitted through the first supporting plate openings 311 of the supporting plate 31 and directed to the second light-outputting zones 3011B of the keycap 3011, so that the second color light beam B2 is outputted from the second light-outputting zones 3011B. The first light guide plate 35 comprises plural first light-guiding parts 351 and plural second light-guiding parts 352. Each of the first light-guiding parts 351 is aligned with a corresponding first light-outputting zone 3011A. In particular, each of the first light-guiding parts 351 is disposed on a bottom surface 353 of the first light guide plate 35 and located under the corresponding first light-outputting zone 3011A for guiding the first color light beam B1 to be directed upwardly to the corresponding first light-outputting zone 3011A. Each of the second light-guiding parts 352 is aligned with a corresponding third light-outputting zone 3011C. In particular, each of the second light-guiding parts 352 is disposed on the bottom surface 353 of the first light guide plate 35 and located under the corresponding third light-outputting zone 3011C for guiding the first color light beam B1 to be directed upwardly to the corresponding third light-outputting zone 3011C.

The second light guide plate 36 comprises plural third light-guiding parts 361 and plural fourth light-guiding parts 362. Each of the third light-guiding parts 361 is aligned with a corresponding second light-outputting zone 3011B. In particular, each of the third light-guiding parts 361 is disposed on a bottom surface 363 of the second light guide plate 36 and located under the corresponding second light-outputting zone 3011B for guiding the second color light beam B2 to be directed upwardly to the corresponding second light-outputting zone 3011B through the corresponding first supporting plate opening 311 of the supporting plate 31 and the first light guide plate 35. Each of the fourth light-guiding parts 362 is aligned with a corresponding third light-outputting zone 3011C. In particular, each of the fourth light-guiding parts 362 is disposed on the bottom surface 363 of the second light guide plate 36 and located under the corresponding third light-outputting zone 3011C for guiding the second color light beam B2 to be directed upwardly to the corresponding third light-outputting zone 3011C through the corresponding second supporting plate opening 312 and the first light guide plate 35. In this embodiment, the first light-guiding parts 351, the second light-guiding parts 352, the third light-guiding parts 361 and the fourth light-guiding parts 362 are all V-cut microstructures. Alternatively, in some other embodiments, the first light-guiding parts, the second light-guiding parts, the third light-guiding parts and the fourth light-guiding parts are all texturing structures. Alternatively, in some other embodiments, the third light-guiding parts and the fourth light-guiding parts are light-guiding ink layers. However, if the light-guiding ink layers are used as the first light-guiding parts and the second light-guiding parts, the underlying optical path of the second color light beam B2 will be hindered by the light-guiding ink layers. In other words, the light-guiding ink layers cannot be used as the first light-guiding parts and the second light-guiding parts.

Due to the structures of the first light guide plate 35 and the second light guide plate 36, the first color light beam B1 and the second color light beam B2 are subjected to total internal reflection within the first light guide plate 35 and the second light guide plate 36, respectively. Moreover, after the first color light beam B1 is projected on the first light-guiding parts 351 or the second light-guiding parts 352, the first color light beam B1 is directed upwardly to the first light-outputting zones 3011A or the third light-outputting zones 3011C. Moreover, after the second color light beam B2 is projected on the third light-guiding parts 361 or the fourth light-guiding parts 362, the second color light beam B2 is directed upwardly to the second light-outputting zones 3011B or the third light-outputting zones 3011C.

The inner structure of the membrane switch circuit member 302 of the keypad module 30 will be illustrated in more details as follows. The membrane switch circuit member 302 is arranged between the supporting plate 31 and the plural keys 301. When the membrane switch circuit member 302 is triggered by the plural keys 301, plural key signals are correspondingly generated. In this embodiment, the membrane switch circuit member 302 comprises an upper wiring board 3021, a spacer layer 3022 and a lower wiring board 3023. The upper wiring board 3021 has plural upper contacts 3021A. The spacer layer 3022 is located under the upper wiring board 3021. Moreover, the spacer layer 3022 comprises plural perforations 3022A corresponding to the plural upper contacts 3021A. When the membrane switch circuit member 302 is depressed, a corresponding upper contact 3021A is inserted into the corresponding perforation 3022A. The lower wiring board 3023 is located under the spacer layer 3022. Moreover, the lower wiring board 3023 comprises plural lower contacts 3023A corresponding to the plural upper contacts 3021A. The plural upper contacts 3021A, the plural perforations 3022A and the plural lower contacts 3023A are collectively defined as plural key switches 3024.

The reflecting part 37 is located under the second light guide plate 36 for reflecting the second color light beam B2. Consequently, the second color light beam B2 is directed upwardly and introduced into the second light guide plate 36 again. Under this circumstance, the utilization efficiency of the second color light beam B2 is enhanced. In this embodiment, the reflecting part 37 is a reflecting plate.

The illumination of the luminous keyboard device 3 will be illustrated as follows. When the luminous keyboard device 3 is driven and enabled, the first light-emitting element 33 and the second light-emitting element 34 emit the first color light beam B1 and the second color light beam B2, respectively. Since the illumination circuit board 32 is arranged between the first light-emitting element 33 and the second light-emitting element 34, the first color light beam B1 and the second color light beam B2 are separated by the illumination circuit board 32 and the first color light beam B1 and the second color light beam B2 are not mixed with each other. After the first color light beam B1 is introduced into the first light guide plate 35, the first color light beam B1 is subjected to total internal reflection within the first light guide plate 35. When the first color light beam B1 is projected on the plural first light-guiding parts 351, the total internal reflection of the first color light beam B1 is destroyed by the plural first light-guiding parts 351, and the first color light beam B1 is guided by the plural first light-guiding parts 351 to be directed upwardly. Under this circumstance, the first color light beam B1 is directed to the plural first light-outputting zones 3011A through the membrane switch circuit member 302, and thus the plural first light-outputting zones 3011A of the keycaps 3011 are illuminated by a red light beam.

On the other hand, after the second color light beam B2 is introduced into the second light guide plate 36, the second color light beam B2 is subjected to total internal reflection within the second light guide plate 36. When the second color light beam B2 is projected on the plural third light-guiding parts 361, the total internal reflection of the second color light beam B2 is destroyed by the plural third light-guiding parts 361, and the second color light beam B2 is guided by the plural third light-guiding parts 361 to be directed upwardly. Under this circumstance, the second color light beam B2 is directed to the plural second light-outputting zones 3011B through the first supporting plate opening 311, the first light guide plate 35 and the membrane switch circuit member 302 sequentially. Meanwhile, the plural second light-outputting zones 3011B of the keycaps 3011 are illuminated by a blue light beam. Moreover, during the process of directing the second color light beam B2 to the second light-outputting zones 3011B, the second color light beam B2 is transmitted through the first light guide plate 35, but is not subjected to total internal reflection within the first light guide plate 35. Since the second color light beam B2 is not influenced by the first color light beam B1, the second color light beam B2 is not mixed with the first color light beam B1.

The portion of the first color light beam B1 that is not projected on the plural first light-guiding parts 351 of the first light guide plate 35 is continuously subjected to total internal reflection within the first light guide plate 35. When the first color light beam B1 is projected on the plural second light-guiding parts 352, the total internal reflection of the first color light beam B1 is destroyed by the plural second light-guiding parts 352, and the first color light beam B1 is guided by the plural second light-guiding parts 352 to be directed upwardly. Under this circumstance, the first color light beam B1 is directed to the plural third light-outputting zones 3011C through the membrane switch circuit member 302. Similarly, the portion of the second color light beam B2 that is not projected on the plural third light-guiding parts 361 of the second light guide plate 36 is continuously subjected to total internal reflection within the second light guide plate 36. When the second color light beam B2 is projected on the plural fourth light-guiding parts 362, the total internal reflection of the second color light beam B2 is destroyed by the plural fourth light-guiding parts 362, and the second color light beam B2 is guided by the plural fourth light-guiding parts 362 to be directed upwardly. Under this circumstance, the second color light beam B2 is directed to the plural third light-outputting zones 3011C through the second supporting plate opening 312, the first light guide plate 35 and the membrane switch circuit member 302 sequentially. After the second color light beam B2 is departed from the membrane switch circuit member 302 and before the second color light beam B2 is projected on the third light-outputting zones 3011C, the second color light beam B2 and the first color light beam B1 are mixed as a third color light beam B3. Consequently, the plural third light-outputting zones 3011C are illuminated by the third color light beam B3. In this embodiment, the third color light beam B3 is a purple light beam.

Of course, during the total internal reflection of the second color light beam B2 within the second light guide plate 36, a portion of the second color light beam B2 is possibly leaked from the second light guide plate 36. The portion of the second color light beam B2 leaked from the second light guide plate 36 can be reflected by the reflecting part 37, which is located under the second light guide plate 36. Consequently, the leaked portion of the second color light beam B2 is introduced into the second light guide plate 36 again, and the utilization efficiency of the second color light beam B2 is enhanced.

From the above discussions of FIG. 4, the plural second light-guiding parts 352 and the plural fourth light-guiding parts 362 are all located under the plural third light-outputting zones 3011C, wherein the plural second light-guiding parts 352 are located over the plural fourth light-guiding parts 362. Consequently, the first color light beam B1 guided by the plural second light-guiding parts 352 and the second color light beam B2 guided by the plural fourth light-guiding parts 362 are mixed with each other as the third color light beam B3. As a consequence, the luminous keyboard device 3 can exhibit three type of illuminating effects by using two light-emitting elements.

Figure 5:
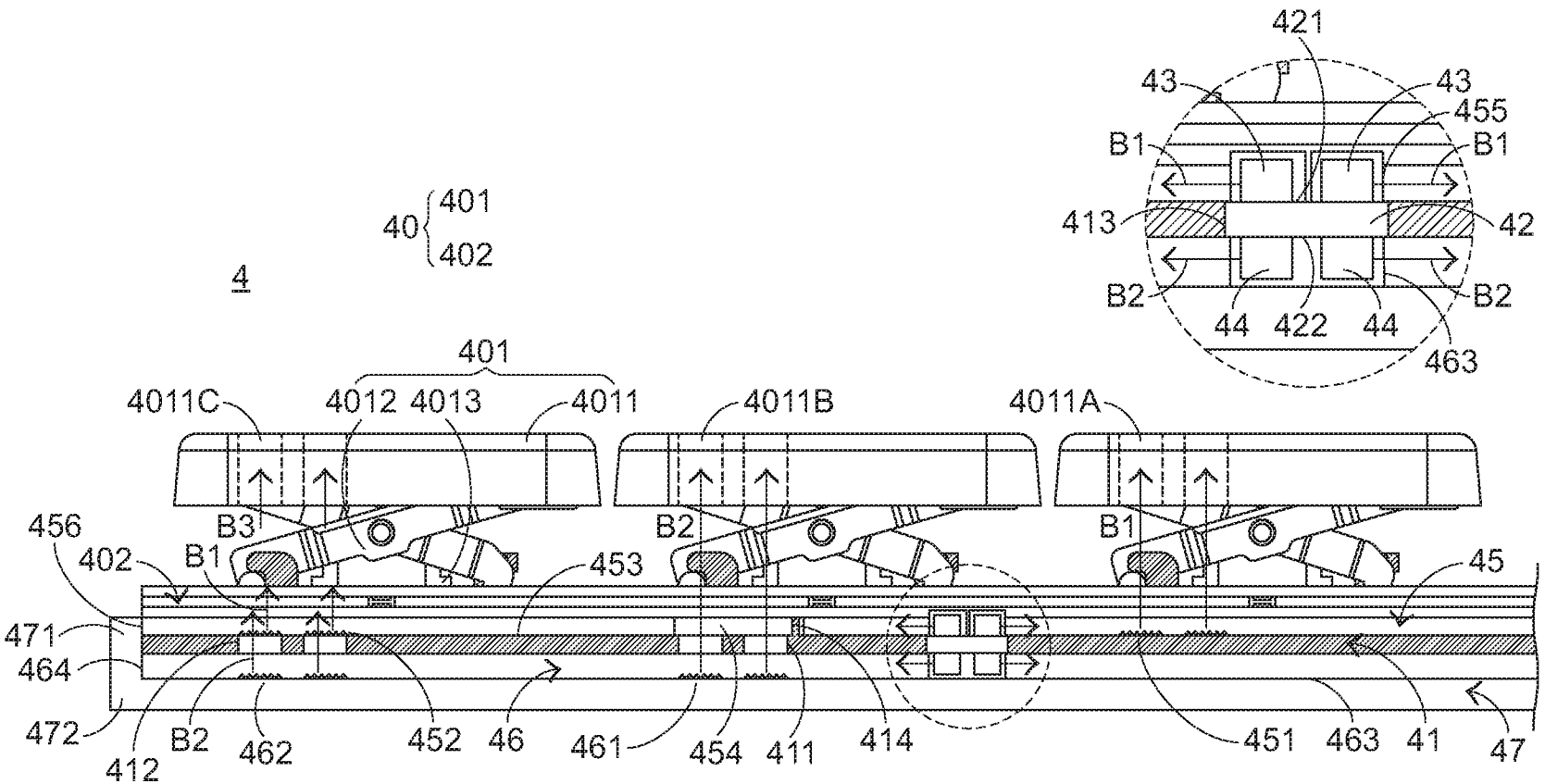
FIG. 5 is a schematic cross-sectional view illustrating a luminous keyboard device according to a second embodiment of the present invention.

The present invention further provides a luminous keyboard device according to a second embodiment of the present invention. FIG. 5 is a schematic cross-sectional view illustrating a luminous keyboard device according to a second embodiment of the present invention. As shown in FIG. 5, the luminous keyboard device 4 comprises a keypad module 40, a supporting plate 41, an illumination circuit board 42, plural first light-emitting elements 43, plural second light-emitting elements 44, a first light guide plate 45, a second light guide plate 46, and a reflecting part 47. The keypad module 40 is exposed to a top surface of the luminous keyboard device 4. Moreover, the keypad module 40 comprises plural keys 401 and a membrane switch circuit member 402. Each of the keys 401 comprises a keycap 4011, a connecting element 4012, and an elastic element 4013. The keycap 4011 is exposed outside the top surface of the luminous keyboard device 4. As shown in FIG. 5, plural first light-outputting zones 4011A, plural second light-outputting zones 4011B and plural third light-outputting zones 4011C are formed on different keycaps 4011, respectively. The supporting plate 41 comprises plural first supporting plate openings 411, plural second supporting plate openings 412 and a third supporting plate opening 413. The first light guide plate 45 comprises plural first light-guiding parts 451 and plural second light-guiding parts 452. The second light guide plate 46 comprises plural third light-guiding parts 461 and plural fourth light-guiding parts 462.

Except for the following five items, the structures and the operations of the luminous keyboard device 4 of this embodiment are substantially identical to those of the luminous keyboard device 3 of the first embodiment, and are not redundantly described herein.

Firstly, the illumination circuit board 42 of the luminous keyboard device 4 of this embodiment is not located at a lateral edge of the supporting plate 41. On the other hand, the illumination circuit board 42 is disposed within the third supporting plate opening 413 of the supporting plate 41. The third supporting plate opening 413 is aligned with the illumination circuit board 42 for accommodating the illumination circuit board 42. The plural first light-emitting elements 43 are disposed on a top surface 421 of the illumination circuit board 42. The plural second light-emitting elements 44 are disposed on a bottom surface 422 of the illumination circuit board 42.

Secondly, the first light guide plate 45 further comprises a vacant region 454. The vacant region 454 is disposed under the keycap 4011 with the second light-outputting zones 4011B. When a second color light beam B2 from the second light-emitting elements 44 is projected on the plural third light-guiding parts 461, the second color light beam B2 is guided by the plural third light-guiding parts 461 to be directed upwardly. Consequently, the second color light beam B2 is directed to the second light-outputting zones 4011B through the first supporting plate opening 411, the vacant region 454 and the membrane switch circuit member 402 sequentially. In this embodiment, the vacant region 454 is produced by drilling through a specified region of the first light guide plate 45. Due to the vacant region 454, the second color light beam B2 is not transmitted through the first light guide plate 45. In other words, the first color light beam B1 transferred within the first light guide plate 45 is not interfered by the second color light beam B2.

Thirdly, the supporting plate 41 further comprises a partition part 414. The partition part 414 is protruded from a top surface of the supporting plate 41, and inserted into the vacant region 454 of the first light guide plate 45. The partition part 414 is capable of blocking the first color light beam B1 from being introduced into the vacant region 454. Moreover, the partition part 414 is capable of preventing the second color light beam B2 from being introduced into the first light guide plate 45 through the vacant region 454.

Fourthly, the first light guide plate 45 further comprises a first receiving part 455, and the second light guide plate 46 further comprises a second receiving part 463. The first receiving part 455 is aligned with the third supporting plate opening 413 and located over the third supporting plate opening 413 for accommodating the first light-emitting elements 43. The second receiving part 463 is aligned with the third supporting plate opening 413 and located under the third supporting plate opening 413 for accommodating the second light-emitting elements 44.

Fifthly, the reflecting part 47 of this embodiment is a reflecting plate. Moreover, the reflecting part 47 comprises a bent structure 471. The bent structure 471 is located at a lateral edge 472 of the reflecting part 47 for enclose a lateral edge 464 of the second light guide plate 46 and a lateral edge 456 of the first light guide plate 45. Due to the bent structure 471, the problem of causing lateral light leakage of the first color light beam B1 and the second color light beam B2 will be eliminated.

From the above discussions, the operations of the luminous keyboard device 4 of this embodiment are substantially identical to those of the luminous keyboard device 3 of the first embodiment. In addition, the luminous efficacy of the luminous keyboard device 4 of this embodiment is identical to that of the luminous keyboard device 3. Moreover, due to the vacant region 454 and the partition part 414, the light-discriminating efficacy of the luminous keyboard device 4 of this embodiment is enhanced.

Figure 6:
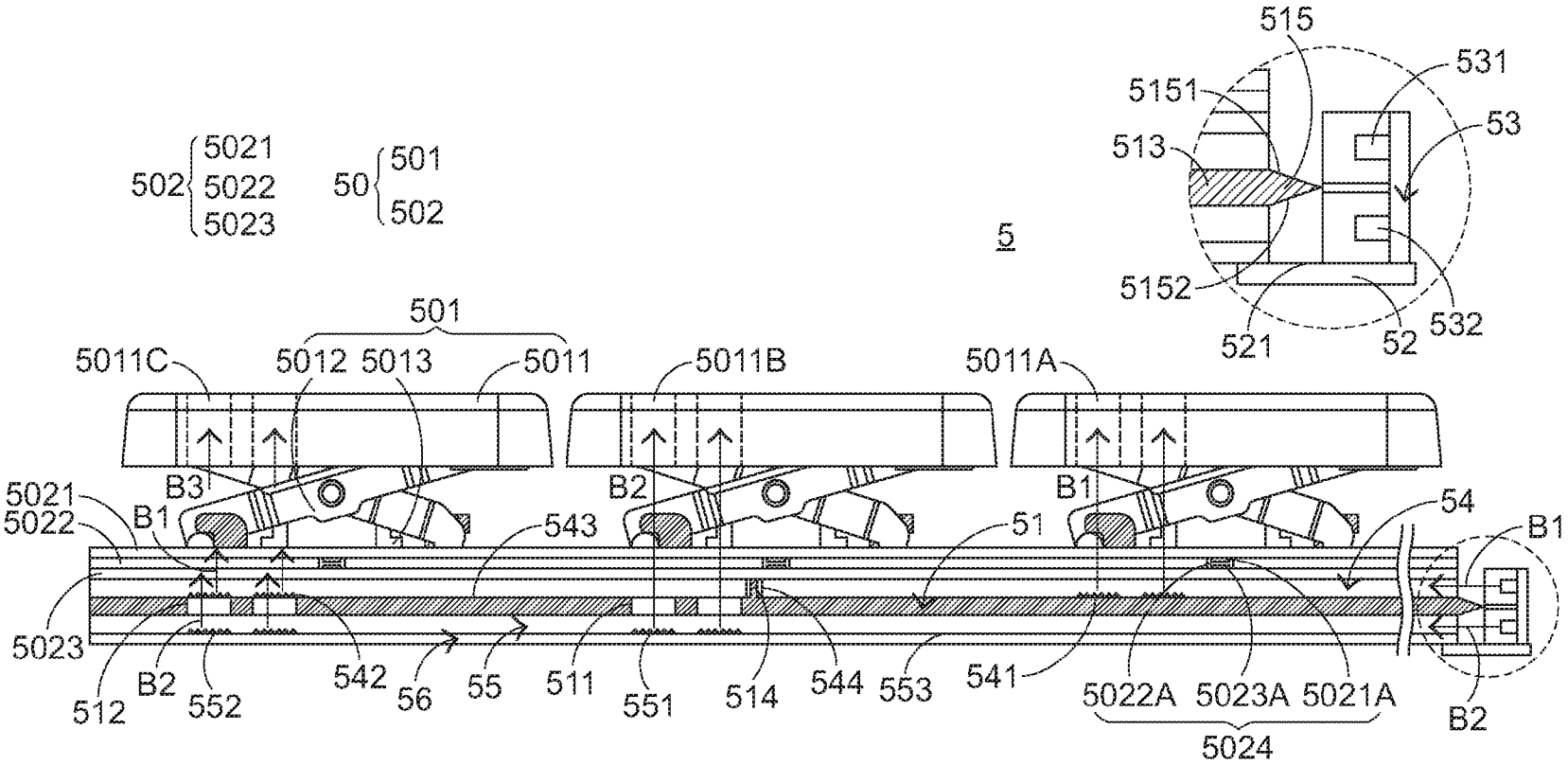
FIG. 6 is a schematic cross-sectional view illustrating a luminous keyboard device according to a third embodiment of the present invention.

The present invention further provides a luminous keyboard device according to a third embodiment of the present invention. FIG. 6 is a schematic cross-sectional view illustrating a luminous keyboard device according to a third embodiment of the present invention. As shown in FIG. 6, the luminous keyboard device 5 comprises a keypad module 50, a supporting plate 51, an illumination circuit board 52, a light-mixing type light-emitting element 53, a first light guide plate 54, a second light guide plate 55, and a reflecting part 56.

The keypad module 50 is exposed to a top surface of the luminous keyboard device 5. Moreover, the keypad module 50 comprises plural keys 501 and a membrane switch circuit member 502. Each of the keys 501 comprises a keycap 5011, a connecting element 5012, and an elastic element 5013. The keycap 5011 is exposed outside the top surface of the luminous keyboard device 5. As shown in FIG. 6, the right keycap 5011 has plural first light-outputting zones 5011A, the middle keycap 5011 has plural second light-outputting zones 5011B, and the left keycap 5011 has plural third light-outputting zones 5011C. The connecting element 5012 is arranged between the supporting plate 51 and the keycap 5011. The connecting element 5012 is used for connecting the supporting plate 51 and the keycap 5011 and allowing the keycap 5011 to be moved upwardly or downwardly relative to the supporting plate 51. The elastic element 5013 is arranged between the membrane switch circuit member 502 and the keycap 5011 for providing an elastic force to the keycap 5011. In response to the elastic force, the keycap 5011 can be returned to its original position. In this embodiment, the luminous keyboard device 5 is a keyboard device for a notebook computer (not shown). Moreover, the connecting element 5012 is a scissors-type connecting element, and the elastic element 5013 is a light-transmissible rubbery elastomer.

As shown in FIG. 6, the supporting plate 51 is located under the keypad module 50 and connected with the plural connecting elements 5012 of the keypad module 50 for supporting the keypad module 50. The supporting plate 51 comprises plural first supporting plate openings 511, plural second supporting plate openings 512, a first partition part 514 and a second partition part 515. Each of the first supporting plate openings 511 is aligned with a corresponding second light-outputting zone 5011B and located under the corresponding second light-outputting zone 5011B. Each of the second supporting plate openings 512 is aligned with a corresponding third light-outputting zone 5011C and located under the corresponding third light-outputting zone 5011C. The first partition part 514 is protruded from a top surface of the supporting plate 51. The second partition part 515 is located at a lateral edge 513 of the supporting plate 51. In particular, the second partition part 515 is arranged between a first light-emitting part 531 and a second light-emitting part 532 of the light-mixing type light-emitting element 53. Due to the second partition part 515, a first color light beam B1 from the first light-emitting part 531 and a second color light beam B2 from the second light-emitting part 532 are not mixed with each other, and the first color light beam B1 and the second color light beam B2 are guided to be introduced into the first light guide plate 54 and the second light guide plate 55, respectively.

Moreover, the second partition part 515 has a first light-guiding slant surface 5151 and a second light-guiding slant surface 5152. The first light-guiding slant surface 5151 is disposed on a first surface of the second partition part 515 and faces the first light guide plate 54. The first color light beam B1 is guided by the first light-guiding slant surface 5151 to be introduced into the first light guide plate 54. The second light-guiding slant surface 5152 is disposed on a second surface of the second partition part 515, and located under the first light-guiding slant surface 5151. Moreover, the second light-guiding slant surface 5152 faces the second light guide plate 55. The second color light beam B2 is guided by the second light-guiding slant surface 5152 to be introduced into the second light guide plate 55. The first partition part 514 is protruded from a top surface of the supporting plate 51. In this embodiment, the supporting plate 51 is made of an opaque material. Moreover, the second partition part 515 and the first partition part 514 are integrally formed with the supporting plate 51.

Since the second partition part 515 has the first light-guiding slant surface 5151 and the second light-guiding slant surface 5152, the fractions of the light-outputting surfaces of the first light-emitting part 531 and the second light-emitting part 532 shielded by the supporting plate 51 will be reduced. Under this circumstance, the light amount of the first color light beam B1 to be introduced into the first light guide plate 54 and the light amount of the second color light beam B2 to be introduced into the second light guide plate 55 can be increased, and thus the luminous efficiency can be enhanced. Moreover, due to the first light-guiding slant surface 5151 and the second light-guiding slant surface 5152, the efficiency of discriminating the first color light beam B1 and the second color light beam B2 will be increased.

The illumination circuit board 52 is located near the supporting plate 51 and located at a lateral edge 513 of the supporting plate 51 for providing electric power to the light-mixing type light-emitting element 53. The light-mixing type light-emitting element 53 is disposed on a top surface 521 of the illumination circuit board 52 and located near the supporting plate 51. The light-mixing type light-emitting element 53 comprises the first light-emitting part 531 and the second light-emitting part 532. By acquiring the electric power from the illumination circuit board 52, the first light-emitting part 531 emits a first color light beam B1. By acquiring the electric power, the second light-emitting part 532 emits a second color light beam B2. In this embodiment, the illumination circuit board 52 is a printed circuit board. Moreover, the light-emitting element 53 is a side-view light-emitting diode. The first color light beam B1 is a red light beam, and the second color light beam B2 is a blue light beam. Alternatively, the first color light beam from the first light-emitting part 531 is not limited to the red light beam, and the second color light beam from the second light-emitting part 532 is not limited to the blue light beam.

The first light guide plate 54 is arranged between the membrane switch circuit member 502 of the keypad module 50 and the supporting plate 51 for guiding the first color light beam B1 to be directed to the first light-outputting zones 5011A of the keycap 5011, so that the first color light beam B1 is outputted from the first light-outputting zones 5011A. The second light guide plate 55 is located under the supporting plate 51 for guiding the second color light beam B2 to be transmitted through the first supporting plate openings 511 of the supporting plate 51 and directed to the second light-outputting zones 5011B of the keycap 5011, so that the second color light beam B2 is outputted from the second light-outputting zones 5011B. The first light guide plate 54 comprises plural first light-guiding parts 541, plural second light-guiding parts 542 and a vacant region 544. Each of the first light-guiding parts 541 is aligned with a corresponding first light-outputting zone 5011A. In particular, each of the first light-guiding parts 541 is disposed on a bottom surface 543 of the first light guide plate 54 and located under the corresponding first light-outputting zone 5011A for guiding the first color light beam B1 to be directed upwardly to the corresponding first light-outputting zone 5011A. Each of the second light-guiding parts 542 is aligned with a corresponding third light-outputting zone 5011C. In particular, each of the second light-guiding parts 542 is disposed on the bottom surface 543 of the first light guide plate 54 and located under the corresponding third light-outputting zone 5011C for guiding the first color light beam B1 to be directed upwardly to the corresponding third light-outputting zone 5011C.

The second light guide plate 55 comprises plural third light-guiding parts 551 and plural fourth light-guiding parts 552. Each of the third light-guiding parts 551 is aligned with a corresponding second light-outputting zone 5011B. In particular, each of the third light-guiding parts 551 is disposed on a bottom surface 553 of the second light guide plate 55 and located under the corresponding second light-outputting zone 5011B for guiding the second color light beam B2 to be directed upwardly to the corresponding second light-outputting zone 5011B through the corresponding first supporting plate opening 511 of the supporting plate 51 and the first light guide plate 54. Each of the fourth light-guiding parts 552 is aligned with a corresponding third light-outputting zone 5011C. In particular, each of the fourth light-guiding parts 552 is disposed on the bottom surface 553 of the second light guide plate 55 and located under the corresponding third light-outputting zone 5011C for guiding the second color light beam B2 to be directed upwardly to the corresponding third light-outputting zone 5011C through the corresponding second supporting plate opening 512 of the supporting plate 51 and the first light guide plate 54. The vacant region 544 is arranged between the third light-guiding parts 551 of the second light guide plate 55 and the light-mixing type light-emitting element 53. The first partition part 514 of the supporting plate 51 is inserted into the vacant region 544 for blocking the first color light beam B1 from being introduced into the vacant region 544. In this embodiment, the first light-guiding parts 541, the second light-guiding parts 542, the third light-guiding parts 551 and the fourth light-guiding parts 552 are all texturing structures, and the vacant region 544 is a gap.

The inner structure of the membrane switch circuit member 502 of the keypad module 50 will be illustrated in more details as follows. The membrane switch circuit member 502 is arranged between the supporting plate 51 and the plural keys 501. When the membrane switch circuit member 502 is triggered by the plural keys 501, plural key signals are correspondingly generated. In this embodiment, the membrane switch circuit member 502 comprises an upper wiring board 5021, a spacer layer 5022 and a lower wiring board 5023. The upper wiring board 5021 has plural upper contacts 5021A. The spacer layer 5022 is located under the upper wiring board 5021. Moreover, the spacer layer 5022 comprises plural perforations 5022A corresponding to the plural upper contacts 5021A. When the membrane switch circuit member 502 is depressed, a corresponding upper contact 5021A is inserted into the corresponding perforation 5022A. The lower wiring board 5023 is located under the spacer layer 5022. Moreover, the lower wiring board 5023 comprises plural lower contacts 5023A corresponding to the plural upper contacts 5021A. The plural upper contacts 5021A, the plural perforations 5022A and the plural lower contacts 5023A are collectively defined as plural key switches 5024.

As shown in FIG. 6, the reflecting part 56 is located under the second light guide plate 55 for reflecting the second color light beam B2. Consequently, the second color light beam B2 is directed upwardly and introduced into the second light guide plate 55 again. Under this circumstance, the utilization efficiency of the second color light beam B2 is enhanced. In this embodiment, the reflecting part 56 is a reflecting plate. The operations of the luminous keyboard device 5 of this embodiment are substantially identical to those of the luminous keyboard device 3 of the first embodiment, and are not redundantly described herein.

From the above discussions about the luminous keyboard device 5 of this embodiment, the first partition part 514 of the supporting plate 51 is inserted into the vacant region 544 of the first light guide plate 54. Consequently, the portion of the first color light beam B1 which is subjected to total internal reflection within the first light guide plate 54 will not be directed to the positions over the third light-guiding parts 551. Under this circumstance, since the first color light beam B1 is not close to the optical path of the second color light beam B2, the possibility of mixing the first color light beam B1 with the second color light beam B2 will be minimized. Moreover, since the second partition part 515 is located at the lateral edge of the supporting plate 51, the first color light beam B1 and the second color light beam B2 are not mixed with each other, and the first color light beam B1 and the second color light beam B2 are guided to be introduced into the first light guide plate 54 and the second light guide plate 55, respectively.

Figure 7:
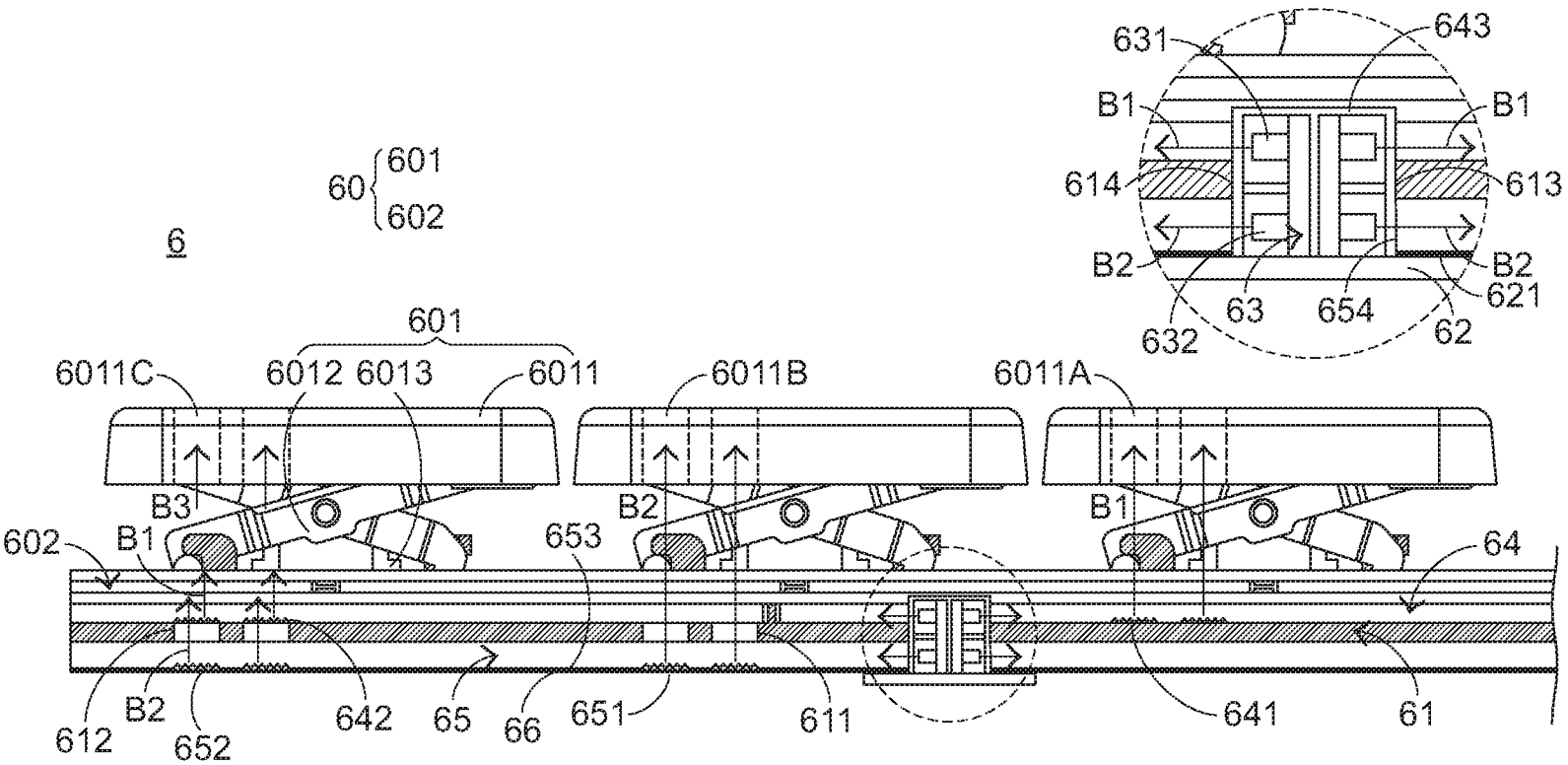
FIG. 7 is a schematic cross-sectional view illustrating a luminous keyboard device according to a fourth embodiment of the present invention.

The present invention further provides a luminous keyboard device according to a fourth embodiment of the present invention. FIG. 7 is a schematic cross-sectional view illustrating a luminous keyboard device according to a fourth embodiment of the present invention. As shown in FIG. 7, the luminous keyboard device 6 comprises a keypad module 60, a supporting plate 61, an illumination circuit board 62, plural light-mixing type light-emitting elements 63, a first light guide plate 64, a second light guide plate 65, and a reflecting part 66. The keypad module 60 is exposed to a top surface of the luminous keyboard device 6. Moreover, the keypad module 60 comprises plural keys 601 and a membrane switch circuit member 602. Each of the keys 601 comprises a keycap 6011, a connecting element 6012, and an elastic element 6013. The keycap 6011 is exposed outside the top surface of the luminous keyboard device 6. Moreover, plural first light-outputting zones 6011A, plural second light-outputting zones 6011B and plural third light-outputting zones 6011C are formed on different keycaps 6011. The supporting plate 61 comprises plural first supporting plate openings 611, plural second supporting plate openings 612, a third supporting plate opening 613 and a partition part 614. The plural light-mixing type light-emitting elements 63 are located near the supporting plate 61. Moreover, each of the light-mixing type light-emitting elements 63 comprises a first light-emitting part 631 and a second light-emitting part 632. The first light guide plate 64 comprises plural first light-guiding parts 641, plural second light-guiding parts 642 and a first receiving part 643. The second light guide plate 65 comprises plural third light-guiding parts 651, plural fourth light-guiding parts 652 and a second receiving part 654.

Except for the following four items, the structures and the operations of the luminous keyboard device 6 of this embodiment are substantially identical to those of the luminous keyboard device 5 of the third embodiment, and are not redundantly described herein.

Firstly, the illumination circuit board 62 of the luminous keyboard device 6 of this embodiment is not located at a lateral edge of the supporting plate 61. Whereas, the illumination circuit board 62 is located under the third supporting plate opening 613 of the supporting plate 61. The third supporting plate opening 613 is aligned with the light-mixing type light-emitting elements 63 for accommodating the light-mixing type light-emitting elements 63. In addition, the light-mixing type light-emitting elements 63 are disposed on a top surface 621 of the illumination circuit board 62.

Secondly, a partition part 614 is located beside a sidewall of the third supporting plate opening 613. Moreover, the partition part 614 is arranged between the first light-emitting part 631 and the second light-emitting part 632. Due to the second partition part 614, a first color light beam B1 from the first light-emitting part 631 and a second color light beam B2 from the second light-emitting part 632 are not mixed with each other, and the first color light beam B1 and the second color light beam B2 are guided to be introduced into the first light guide plate 64 and the second light guide plate 65, respectively.

Thirdly, the first light guide plate 64 further comprises a first receiving part 643, and the second light guide plate 65 further comprises a second receiving part 654. The first receiving part 643 is aligned with the third supporting plate opening 613 and located over the third supporting plate opening 613. The second receiving part 654 is aligned with the third supporting plate opening 613 and located under the third supporting plate opening 613. The light-mixing type light-emitting elements 63 are accommodated within the first receiving part 643 and the second receiving part 654 collaboratively.

Fourthly, the reflecting part 66 of this embodiment is a reflective ink layer, which is printed on a bottom surface 653 of the second light guide plate 65.

From the above descriptions, the present invention provides a luminous keyboard device. The luminous keyboard device comprises two light-emitting elements or a light-mixing type light-emitting element for emitting a first color light beam and a second color light beam of different colors. Moreover, the first color light beam and the second color light beam are guided by a first light guide plate and a second light guide plate to be directed to a first light-outputting zone and a second light-outputting zone, respectively. Consequently, the first light-outputting zone is shown in a first color and a second light-outputting zone is shown in a second color. Moreover, the first color light beam and the second color light beam are guided by the first light guide plate and the second light guide plate to be directed to a third light-outputting zone. During the process of directing the first color light beam and the second color light beam, the two light beams are mixed as a third color light beam. Consequently, the third light-outputting zone is shown in a third color. When compared with the conventional technology, the luminous keyboard device of the present invention can produce the polychromatic luminous efficacy by a simplified fabricating process and with reduced fabricating cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A luminous keyboard device, comprising:

a keypad module exposed to a top surface of said luminous keyboard device;

a supporting plate located under said keypad module and connected with said keypad module for supporting said keypad module, wherein said supporting plate comprises a first supporting plate opening and a second supporting plate opening;

an illumination circuit board located near said supporting plate for providing electric power;

a first light-emitting element disposed on a top surface of said illumination circuit board, wherein in response to said electric power, said first light-emitting element emits a first color light beam;

a second light-emitting element disposed on a bottom surface of said illumination circuit board, wherein in response to said electric power, said second light-emitting element emits a second color light beam;

a first light guide plate arranged between said keypad module and said supporting plate for guiding said first color light beam to be directed to a first light-outputting zone of said keypad module; and a second light guide plate located under said supporting plate for guiding said second color light beam to be directed to a second light-outputting zone of said keypad module through said first supporting plate opening, wherein when said first color light beam is guided by said first light guide plate to be projected on a third light-outputting zone of said keypad module and when said second color light beam is guided by said second light guide plate to be projected on said third light-outputting zone through said second supporting plate opening, said first color light beam and said second color light beam projected on said third light-outputting zone are mixed as a third color light beam.

2. The luminous keyboard device according to claim 1, wherein said first light guide plate comprises:

a first light-guiding part disposed on a bottom surface of said first light guide plate and located under said first light-outputting zone for guiding said first color light beam to be directed upwardly to said first light-outputting zone; and a second light-guiding part disposed on said bottom surface of said first light guide plate and located under said third light-outputting zone for guiding said first color light beam to be directed upwardly to said third light-outputting zone.

3. The luminous keyboard device according to claim 1, wherein said second light guide plate comprises:

a third light-guiding part disposed on a bottom surface of said second light guide plate and located under said second light-outputting zone for guiding said second color light beam to be directed upwardly to said second light-outputting zone through said first supporting plate opening; and a fourth light-guiding part disposed on said bottom surface of said second light guide plate and located under said third light-outputting zone for guiding said second color light beam to be directed upwardly to said third light-outputting zone through said second supporting plate opening.

4. The luminous keyboard device according to claim 1, wherein said keypad module comprises:

plural keys exposed to said top surface of said luminous keyboard device, wherein said first light-outputting zone, said second light-outputting zone and said third light-outputting zone are formed on said plural keys; and a membrane switch circuit member arranged between said supporting plate and said plural keys, wherein when said membrane switch circuit member is triggered by said plural keys, plural key signals are correspondingly generated.

5. The luminous keyboard device according to claim 4, wherein each of said plural keys comprises:

a keycap exposed to said top surface of said luminous keyboard device, wherein said first light-outputting zone, said second light-outputting zone or said third light-outputting zone is formed on said keycap;

a connecting element arranged between said supporting plate and said keycap for connecting said supporting plate and said keycap, and allowing said keycap to be moved upwardly and downwardly relative to said supporting plate; and an elastic element arranged between said membrane switch circuit member and said keycap for providing an elastic force to said keycap, wherein said keycap is returned to an original position in response to said elastic force.

6. The luminous keyboard device according to claim 4, wherein said membrane switch circuit member comprises:

an upper wiring board having plural upper contacts;

a spacer layer disposed under said upper wiring board, and having plural perforations corresponding to said plural upper contacts, wherein when said membrane switch circuit member is depressed, a corresponding upper contact is inserted into a corresponding perforation; and a lower wiring board disposed under said spacer layer, and having plural lower contacts corresponding to said plural upper contacts, wherein said plural lower contacts and said plural upper contacts are collectively defined as plural key switches.

7. The luminous keyboard device according to claim 1, further comprising a reflecting part, wherein said reflecting part is disposed under said second light guide plate for reflecting said second color light beam, so that said second color light beam is directed upwardly to be introduced into said second light guide plate.

8. The luminous keyboard device according to claim 1, wherein said first light guide plate further comprises a vacant region, and said vacant region is disposed under said second light-outputting zone, wherein said second color light beam is transmitted through said first supporting plate opening and said vacant region, so that said second color light beam is prevented from being introduced into said first light guide plate.

9. The luminous keyboard device according to claim 8, wherein said supporting plate further comprises a partition part, wherein said partition part is protruded from a top surface of said supporting plate and inserted into said vacant region of said first light guide plate for blocking said first color light beam from being introduced into said vacant region or preventing said second color light beam from being introduced into said first light guide plate through said vacant region.

10. A luminous keyboard device, comprising:

a keypad module exposed to a top surface of said luminous keyboard device;

a supporting plate located under said keypad module and connected with said keypad module for supporting said keypad module, wherein said supporting plate comprises a first supporting plate opening and a second supporting plate opening;

an illumination circuit board located near said supporting plate for providing electric power;

a light-mixing light-emitting element disposed on a top surface of said illumination circuit board and located near the supporting plate, wherein said light-mixing light-emitting element comprises a first light-emitting part and a second light-emitting part, wherein said first light-emitting element emits a first color light beam in response to said electric power, and said second light-emitting element emits a second color light beam in response to said electric power;

a first light guide plate arranged between said keypad module and said supporting plate for guiding said first color light beam to be directed to a first light-outputting zone of said keypad module; and a second light guide plate located under said supporting plate for guiding said second color light beam to be directed to a second light-outputting zone of said keypad module through said first supporting plate opening, wherein when said first color light beam is guided by said first light guide plate to be projected on a third light-outputting zone of said keypad module and when said second color light beam is guided by said second light guide plate to be projected on said third light-outputting zone through said second supporting plate opening, said first color light beam and said second color light beam projected on said third light-outputting zone are mixed as a third color light beam.

11. The luminous keyboard device according to claim 10, wherein said first light guide plate comprises:

a first light-guiding part disposed on a bottom surface of said first light guide plate and located under said first light-outputting zone for guiding said first color light beam to be directed upwardly to said first light-outputting zone; and a second light-guiding part disposed on said bottom surface of said first light guide plate and located under said third light-outputting zone for guiding said first color light beam to be directed upwardly to said third light-outputting zone.

12. The luminous keyboard device according to claim 10, wherein said second light guide plate comprises:

a third light-guiding part disposed on a bottom surface of said second light guide plate and located under said second light-outputting zone for guiding said second color light beam to be directed upwardly to said second light-outputting zone through said first supporting plate opening; and a fourth light-guiding part disposed on said bottom surface of said second light guide plate and located under said third light-outputting zone for guiding said second color light beam to be directed upwardly to said third light-outputting zone through said second supporting plate opening.

13. The luminous keyboard device according to claim 10, wherein said keypad module comprises:

plural keys exposed to said top surface of said luminous keyboard device, wherein said first light-outputting zone, said second light-outputting zone and said third light-outputting zone are formed on said plural keys; and a membrane switch circuit member arranged between said supporting plate and said plural keys, wherein when said membrane switch circuit member is triggered by said plural keys, plural key signals are correspondingly generated.

14. The luminous keyboard device according to claim 13, wherein each of said plural keys comprises:

a keycap exposed to said top surface of said luminous keyboard device, wherein said first light-outputting zone, said second light-outputting zone or said third light-outputting zone is formed on said keycap;

a connecting element arranged between said supporting plate and said keycap for connecting said supporting plate and said keycap, and allowing said keycap to be moved upwardly and downwardly relative to said supporting plate; and an elastic element arranged between said membrane switch circuit member and said keycap for providing an elastic force to said keycap, wherein said keycap is returned to an original position in response to said elastic force.

15. The luminous keyboard device according to claim 13, wherein said membrane switch circuit member comprises:

an upper wiring board having plural upper contacts;

a spacer layer disposed under said upper wiring board, and having plural perforations corresponding to said plural upper contacts, wherein when said membrane switch circuit member is depressed, a corresponding upper contact is inserted into a corresponding perforation; and a lower wiring board disposed under said spacer layer, and having plural lower contacts corresponding to said plural upper contacts, wherein said plural lower contacts and said plural upper contacts are collectively defined as plural key switches.

16. The luminous keyboard device according to claim 10, wherein said first light guide plate further comprises a vacant region, and said vacant region is disposed under said second light-outputting zone, wherein said second color light beam is transmitted through said first supporting plate opening and said vacant region, so that said second color light beam is prevented from being introduced into said first light guide plate.

17. The luminous keyboard device according to claim 16, wherein said supporting plate further comprises a first partition part, wherein said first partition part is protruded from a top surface of said supporting plate and inserted into said vacant region of said first light guide plate for blocking said first color light beam from being introduced into said vacant region or preventing said second color light beam from being introduced into said first light guide plate through said vacant region.

18. The luminous keyboard device according to claim 10, wherein said supporting plate further comprises a second partition part, which is located at a lateral edge of said supporting plate and arranged between said first light-emitting part and said second light-emitting part, wherein by said second partition part, said first color light beam and said second color light beam are not mixed with each other, and said first color light beam and said second color light beam are guided to be introduced into said first light guide plate and said second light guide plate, respectively.

19. The luminous keyboard device according to claim 18, wherein said second partition part comprises:

a first light-guiding slant surface disposed on a first surface of said second partition part for guiding said first color light beam to be introduced into said first light guide plate; and a second light-guiding slant surface disposed on a second surface of said second partition part and located under said first light-guiding slant surface for guiding said second color light beam to be introduced into said second light guide plate.

20. The luminous keyboard device according to claim 10, wherein said supporting plate further comprises:

a third supporting plate opening formed in said supporting plate, wherein said light-mixing light-emitting element is inserted into said third supporting plate opening; and a second partition part located beside a sidewall of said third supporting plate opening and arranged between said first light-emitting part and said second light-emitting part, wherein by said second partition part, said first color light beam and said second color light beam are not mixed with each other, and said first color light beam and said second color light beam are guided to be introduced into said first light guide plate and said second light guide plate, respectively.

* * * * *